US011774205B1

(12) United States Patent
Kunsky

(10) Patent No.: US 11,774,205 B1
(45) Date of Patent: Oct. 3, 2023

(54) BAFFLE FOR SHOTGUN SUPPRESSOR

(71) Applicant: Jacob Kunsky, Bruneau, ID (US)

(72) Inventor: Jacob Kunsky, Bruneau, ID (US)

( * ) Notice: Subject to any disclaimer, the term of this patent is extended or adjusted under 35 U.S.C. 154(b) by 0 days.

(21) Appl. No.: 18/103,003

(22) Filed: Jan. 30, 2023

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 21/36; F41A 21/40; F41A 21/42
See application file for complete search history.

(56) References Cited

U.S. PATENT DOCUMENTS 5,679,916 A * 10/1997 Weichert ..... F41A 21/30 181/232
6,374,718 B1 * 4/2002 Rescigno ..... F41A 21/30 89/14.4
8,100,224 B1 * 1/2012 Olson ..... F41A 21/30 181/267
10,119,779 B1 * 11/2018 Miele ..... F41A 21/30
10,502,512 B1 * 12/2019 Beaudry ..... F41A 21/28
2012/0272818 A1 * 11/2012 Dueck ..... F41A 21/30 29/896.2
2017/0160035 A1 * 6/2017 Piemme ..... C22C 33/0285
2017/0299313 A1 * 10/2017 Adamson, Jr. ..... F41A 21/30
2017/0321984 A1 * 11/2017 Palu ..... F41A 21/34
2018/0313624 A1 * 11/2018 Smith ..... F41A 21/30
2018/0340749 A1 * 11/2018 Palu ..... F41A 21/30
2019/0339036 A1 * 11/2019 Edminster ..... F41A 21/30
2020/0141679 A1 * 5/2020 Garst ..... F41A 21/30
2021/0341246 A1 * 11/2021 Kunsky ..... F41A 21/30
2021/0381791 A1 * 12/2021 Magee ..... F41A 21/30
2021/0396485 A1 * 12/2021 Reis-Green ..... F41A 21/30
2022/0397361 A1 * 12/2022 DeJessa ..... F41A 21/30
2022/0397362 A1 * 12/2022 DeJessa ..... F41A 21/30
2022/0397363 A1 * 12/2022 DeJessa ..... F41A 21/30
2023/0003479 A1 * 1/2023 Berg ..... F41A 21/30

* cited by examiner

*Primary Examiner* — Joshua E Freeman
(74) *Attorney, Agent, or Firm* — Parsons Behle & Latimer

(57) ABSTRACT

A suppressor for suppressing the discharge of a shotgun. The suppressor includes a base having a first end, a second end, and a first passageway through the base from the first end to the second end. The suppressor includes an end cap having a second passageway through an interior of the end cap. The suppressor includes at least one baffle positioned between the base and the end cap. The baffle includes a lower portion having a first end, a second end, and a first flow path through an interior of the lower portion. The baffle includes an upper portion having an interior, an exterior, and a second flow path through the interior of the upper portion. The upper portion of the baffle includes a first end, a middle section, and a second end. The second end of the upper portion of the baffle may be bell-shaped.

16 Claims, 3 Drawing Sheets

BAFFLE FOR SHOTGUN SUPPRESSOR

BACKGROUND

Field of the Disclosure

The examples described herein relate to apparatuses, systems, and methods of a shotgun suppressor and a baffle for a shotgun suppressor.

Description of the Related Art

A firearm suppressor is a device mounted or otherwise attached to the muzzle of a firearm and, through selective use of baffles or other gas-redirection apparatus, operates to diminish the report (as measured in decibels) of a firearm following discharge. By reducing the report of a discharging firearm, suppressors reduce or mitigate hearing damage or loss otherwise resulting from repeated exposure to firearm discharges. A suppressor may be attached to a firearm by various mechanisms.

Firearm suppressors are typically designed for firearms that discharge, or fire, bullets such as handguns and rifles. One type of a firearm, a shotgun, does not typically fire a bullet, but typically fires shot (e.g., a plurality of lead, steel, or other metal pellets). One difficulty in designing a suppressor capable to suppress the discharge of a shotgun is that both a wad and shot are discharged. The wad is a component of the shotgun shell that is used to separate the shot from the powder. The wad provides a seal to propel the shot when the powder is discharged rather than having the gas from the discharge blowing through the shot. The wad typically is made of plastic and expands as it is being discharged from the barrel.

As the wad travels along the suppressor, the wad may expand into gaps between the baffles, which is problematic. The expansion of the wad between baffles may cause the wad to strike the baffles potentially damaging the baffle and/or adding to the sound of the discharge. Additionally, portions of the wad may be broken off as the wad travels through the suppressor. Pieces of the wad, which is often plastic, may collect with the suppressor. If a shotgun is pointed upwards, pieces of the wad may fall from the suppressor and into the chamber of the shotgun, which may cause the action to jam and/or may cause accidental discharge. Other disadvantages may exist.

SUMMARY

The present disclosure is directed to apparatus, systems, and methods of a shotgun suppressor and a baffle for a shotgun suppressor.

One example of the present disclosure is a shotgun suppressor. The suppressor includes a base having a first end, a second end, and a first passageway through the base from the first end to the second end. The base configured to be connected to a barrel of a shotgun. The suppressor includes an end cap having a second passageway through an interior of the end cap. The suppressor includes at least one baffle positioned between the base and the end cap.

The baffle includes a lower portion having a first end, a second end, an exterior, an interior, and a first flow path through the interior of the lower portion. The second end of the lower portion of the baffle has a first outer diameter. The baffle includes an external shoulder on the exterior of the lower portion. The baffle includes external threads on the exterior of the lower portion. The external threads are adjacent to the second end of the lower portion. The baffle includes an upper portion having an interior, an exterior, and a second flow path through the interior of the upper portion. The upper portion of the baffle extends from the second end of the lower portion. The upper portion of the baffle includes a first end, a middle section, and a second end. The first end of the upper portion of the baffle has a second outer diameter that is substantially the same as the first outer diameter of the second end of the lower portion. The middle section of the baffle has a third outer diameter that is smaller than the second outer diameter of the first end of the upper portion. The second end of the upper portion of the baffle has a fourth outer diameter. The fourth outer diameter is larger than the third outer diameter of the middle section and is smaller than the second outer diameter of the first end of the upper portion.

The baffle includes a first radius of curvature on the exterior of the upper portion. The first radius of curvature is located between the first end of the upper portion and the middle section of the upper portion. The first radius of curvature decreases from the second outer diameter to the third outer diameter. The baffle includes a second radius of curvature on the exterior of the upper portion. The second radius of curvature is located between the middle section of the upper portion of the baffle and the second end of the upper portion of the baffle. The second radius of curvature increases from the third outer diameter to the fourth outer diameter. The first passageway of the base, the first flow path of the lower portion of the baffle, the second flow path of the upper portion of the baffle, and the second passageway of the end cap are all axially aligned.

The third outer diameter of the baffle may be substantially constant between the first radius of curvature and the second radius of curvature. The suppressor may include a first tube extension positioned between the base and the end cap. The first tube extension includes a third passageway through an interior of the first tube extension. The first passageway, the second passageway, the third passageway, the first flow path, and the second flow path are all axially aligned.

The exterior threads may be located between the external shoulder and the upper portion of the at least one baffle. The suppressor may include a plurality of flats on the exterior of the lower portion of the at least one baffle. The plurality of flats are located between the external shoulder and the first end of the lower portion of the baffle. The second end of the upper portion of the baffle may be bell-shaped.

The suppressor may include a second baffle positioned between the base and the end cap. The second baffle may include a lower portion having a first end, a second end, an exterior, an interior, and a first flow path through the interior of the lower portion. The second baffle may include an upper portion having an interior, an exterior, and a second flow path through the interior of the upper portion. The upper portion may extend from the second end of the lower portion. The upper portion may include a first end, a middle section, and a second end. The second end of the upper portion of the second baffle may bell-shaped. The suppressor may include a second tube extension positioned between the at least one baffle and the second baffle.

One embodiment of the present disclosure is a baffle for a shotgun suppressor. The baffle includes a lower portion having a first end, a second end, an exterior, an interior, and a first flow path through the interior of the lower portion. The second end of the lower portion has a first outer diameter. The baffle includes an upper portion having an interior, an exterior, and a second flow path through the interior of the upper portion. The upper portion extends from the second end of the lower portion. The upper portion has a first end, a middle section, and a second end.

The first end of the upper portion has a second outer diameter that is substantially the same as the first outer diameter of the second end of the lower portion. The middle section has a third outer diameter that is smaller than the second outer diameter of the first end of the upper portion. The third outer diameter is substantially constant. The second end of the upper portion has a fourth outer diameter. The fourth outer diameter is larger than the third outer diameter of the middle section and is smaller than the second outer diameter of the first end of the upper portion.

The baffle includes a first radius of curvature on the exterior of the upper portion. The first radius of curvature is located between the first end of the upper portion and the middle section of the upper portion. The first radius of curvature decreases from the second outer diameter to the third outer diameter. The baffle includes a second radius of curvature on the exterior of the upper portion. The second radius of curvature is located between the middle section of the upper portion and the second end of the upper portion. The second radius of curvature increases from the third outer diameter to the fourth outer diameter.

The second end of the upper portion may be bell-shaped. The first flow path may be axially aligned with the second flow path. The baffle may include an external shoulder on the exterior of the lower portion. The baffle may include external threads on the exterior of the lower portion. The external threads may be located between the external shoulder and the second end of the lower portion. The baffle may include a plurality of flats on the exterior of the lower portion. The plurality of flats may be located between the external shoulder and the first end of the lower portion. The upper portion may not include any holes except the second flow path through the upper portion. The baffle may include at least one hole through the lower portion, wherein the at least one hole provides communication between the interior of the lower portion and the exterior of the lower portion. The baffle may include internal threads. The internal threads may be located on the interior of the lower portion.

One embodiment of the disclosure is a baffle for a shotgun suppressor. The baffle includes a lower portion having a first end, a second end, an exterior, an interior, and a first flow path through the interior of the lower portion. The second end of the lower portion has a first outer diameter. The baffle includes an upper portion having an interior, an exterior, and a second flow path through the interior of the upper portion. The upper portion extends from the second end of the lower portion. The upper portion includes a first end, a middle section, and a second end. The second end of the upper portion is flared out and has a larger outer diameter than an outer diameter of the middle section. The baffle may include external threads on the exterior of the lower portion. The baffle may include internal threads on the interior of the lower portion.

Figure 1:
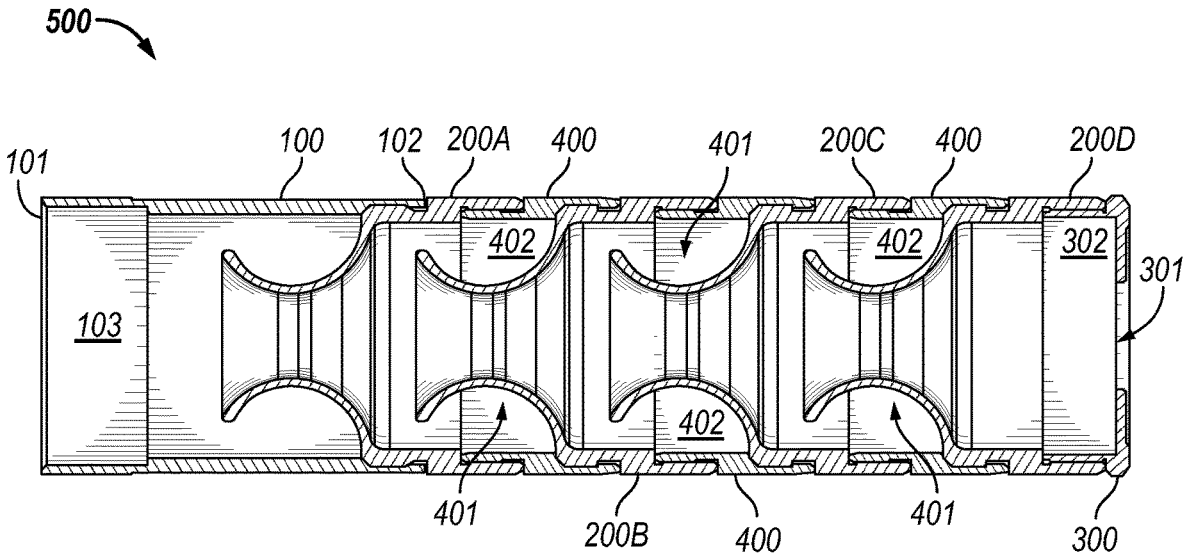
FIG. 1 is a cross-sectional view of an embodiment of a suppressor for a shotgun.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows a cross-sectional view of a suppressor 500 for a shotgun. The suppressor 500 includes a base 100 and an end cap 300. The suppressor 500 includes one or more baffles 200A, 200B, 200C, 200D positioned between the base 100 and the end cap 300. The baffles 200A, 200B, 200C, 200D are configured to suppress the sound of the discharge of a shotgun when the base 100 is attached to the barrel of the shotgun. The bell-shaped baffles 200A, 200B, 200C, 200D discussed herein suppress the discharge while preventing pieces of the wad to break off as the wad travels through the suppressor 500. The wide opening of each baffle 200A, 200B, 200C, 200D enables the wad to enter into the individual baffle while the constriction of the middle section of the baffle compacts the wad together as it passes through each baffle as discussed herein.

The suppressor 500 includes three tube extensions 400 with each of the tube extensions 400 being positioned between adjacent baffles 200A, 200B, 200C, 200D. The tube extensions 400 space apart the baffles 200A, 200B, 200C, 200D. The suppressor includes a base having a first end 101, a second end 102, and a first passageway 103 through the base 100 from the first end 101 to the second end 102. The base 100 configured to be connected to a barrel of a shotgun as would be appreciated by one of ordinary skill having the benefit of this disclosure. The suppressor 500 includes an end cap 300 having a second passageway 301 through an interior 302 of the end cap 300. The suppressor includes at least one baffle (generally) 200 positioned between the base 100 and the end cap 300.

The number and locations of the tube extensions 400 may be varied as would be appreciated by one of ordinary skill in the art having the benefit of this disclosure. For example, two tube extensions 400 could be positioned between adjacent baffles. Likewise, the number and locations of the baffles 200A, 200B, 200C, 200D may be varied as would be appreciated by one of ordinary skill in the art having the benefit of this disclosure. More or less than four baffles 200 (generally) may be used within the suppressor 500.

Figure 2:
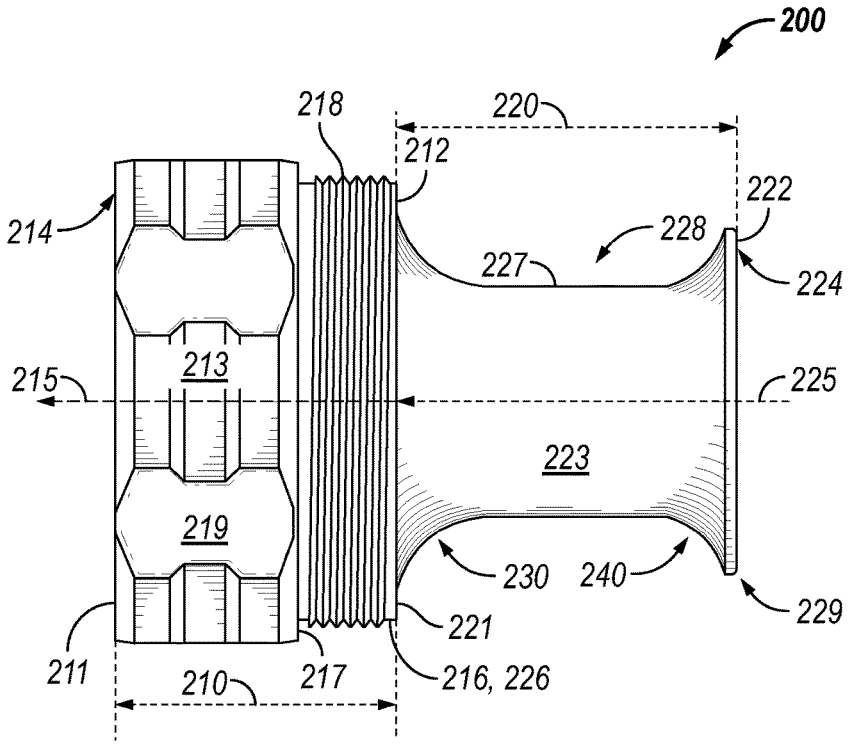
FIG. 2 is a side view of an embodiment of a baffle for a shotgun suppressor.

FIG. 2 shows a side view of a baffle 200. The baffle 200 includes a lower portion 210 having a first end 211, a second end 212, an exterior 213, an interior 214, and a first flow path 215 through the interior 214 of the lower portion 210. The second end of the lower portion 210 of the baffle 200 has a first outer diameter 216. The baffle 200 includes an external shoulder 217 on the exterior 213 of the lower portion 210. The baffle 200 includes external threads 218 on the exterior 213 of the lower portion 210. The external threads 218 are adjacent to the second end 212 of the lower portion 210. The baffle 200 includes an upper portion 220 having a first end 221, a second end 222, an exterior 223, an interior 224, and a second flow path 225 through the interior 224 of the upper portion 220. The upper portion 220 of the baffle 200 extends from the second end 212 of the lower portion 210. The upper portion 220 of the baffle 200 includes a middle section 227 between the first end 221 and the second end 222. The first end 221 of the upper portion 220 of the baffle 200 has a second outer diameter 226 that is substantially the same as the first outer diameter 216 of the second end 212 of the lower portion 210. The middle section 227 of the baffle 200 has a third outer diameter 228 that is smaller than the second outer diameter 226 of the first end 221 of the upper portion 220. The second end 222 of the upper portion 220 of the baffle 200 has a fourth outer diameter 229. The fourth outer diameter 229 is larger than the third outer diameter 228 of the middle section 227 and is smaller than the second outer diameter 226 of the first end 221 of the upper portion 220.

The baffle 200 includes a first radius of curvature 230 on the exterior 223 of the upper portion 220. The first radius of curvature 230 is located between the first end 221 of the upper portion 220 and the middle section 227 of the upper portion 220. The first radius of curvature 230 decreases from the second outer diameter 226 to the third outer diameter 228. The baffle 200 includes a second radius of curvature 240 on the exterior 223 of the upper portion 220. The second radius of curvature 240 is located between the middle section 227 of the upper portion 220 of the baffle 200 and the second end 222 of the upper portion 220 of the baffle 200. The second radius of curvature 240 increases from the third outer diameter 228 to the fourth outer diameter 229. The first passageway 103 of the base 100, the first flow path 215 of the lower portion 210 of the baffle 200, the second flow path 225 of the upper portion 220 of the baffle 200, and the second passageway 301 of the end cap 300 are all axially aligned.

The third outer diameter 228 of the upper portion 220 of the baffle 200 may be substantially constant between the first radius of curvature 203 and the second radius of curvature 240. As shown in FIG. 1, a suppressor 500 that includes the baffle 200 may also include a first tube extension 400 positioned between the base 100 and the end cap 300. The first tube extension 400 includes a third passageway 401 through an interior 402 of the first tube extension 400. The first passageway 103, the second passageway 301, the third passageway 401, the first flow path 215, and the second flow path 225 are all axially aligned.

The exterior threads 218 of the baffle 200 are located between the external shoulder 217 and the upper portion 220 of the baffle 200. The baffle 200 includes a plurality of flats 219 on the exterior 213 of the lower portion 210. The flats 219 may enable the baffle 200 to be connected to and disconnect from components of a suppressor 500. The plurality of flats 219 are located between the external shoulder 217 and the first end 211 of the lower portion 210 of the baffle 200. The second end 222 of the upper portion 220 of the baffle 200 may be bell-shaped as shown in FIG. 2. The wide bell-shaped opening of the second end 222 of the upper portion 220 of the baffle 200 is configured to enable the entire wad to enter into the baffle 200. The decreasing second radius of curvature 240 in combination with the smaller third outer diameter 228 of the middle section 227 of the upper portion 220 of the baffle 200 compress the wad together as it travels through the baffle 200. This compression may help to ensure that the entire wad enters into the next baffle 200 located in the suppressor 500.

Figure 3:
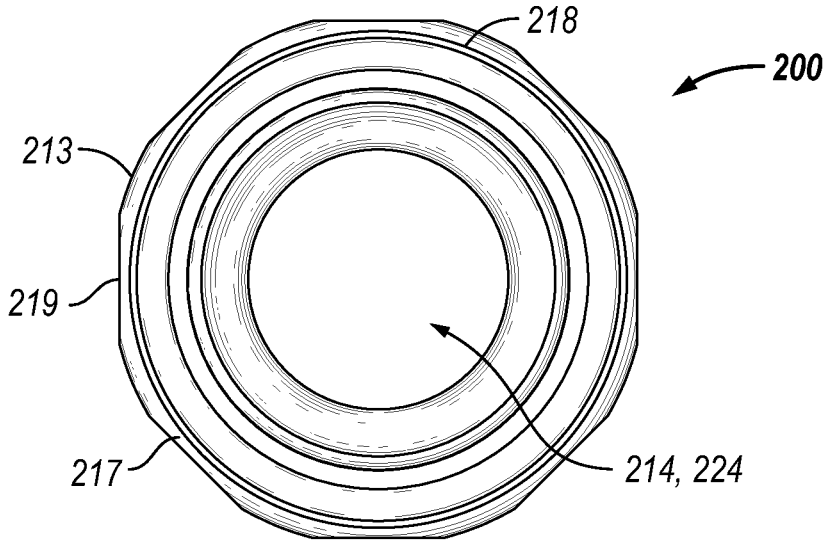
FIG. 3 is an end view of an embodiment of a baffle for a shotgun suppressor.
Figure 4:
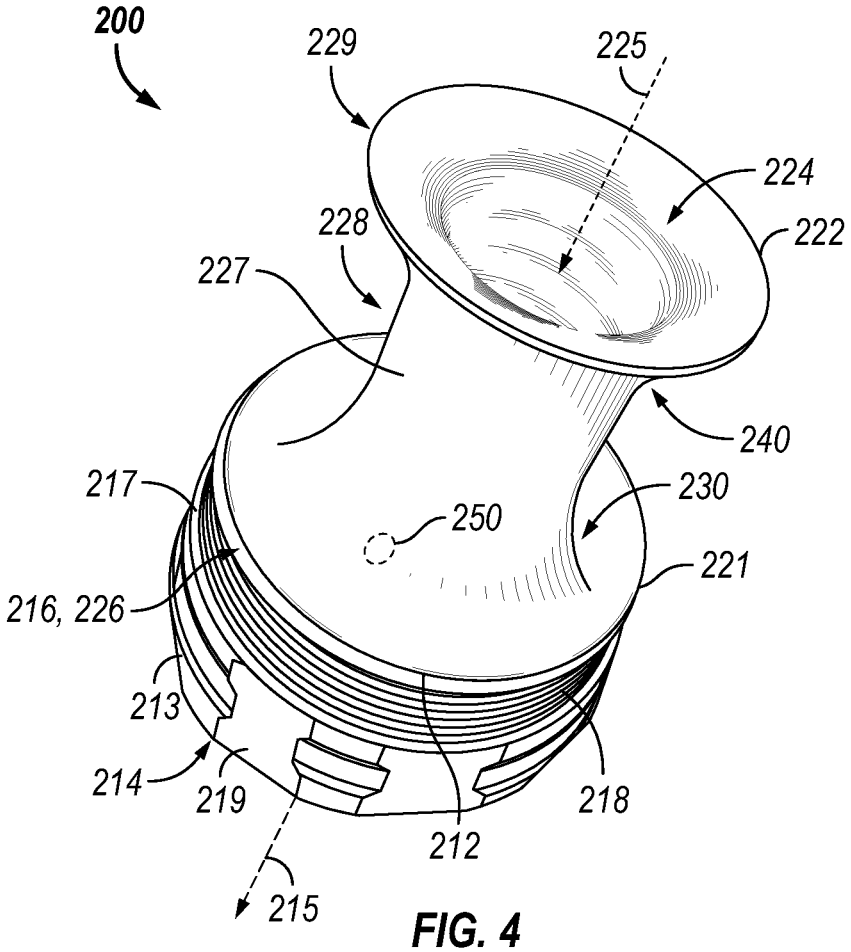
FIG. 4 is a perspective view of an embodiment of a baffle for a shotgun suppressor.
Figure 5:
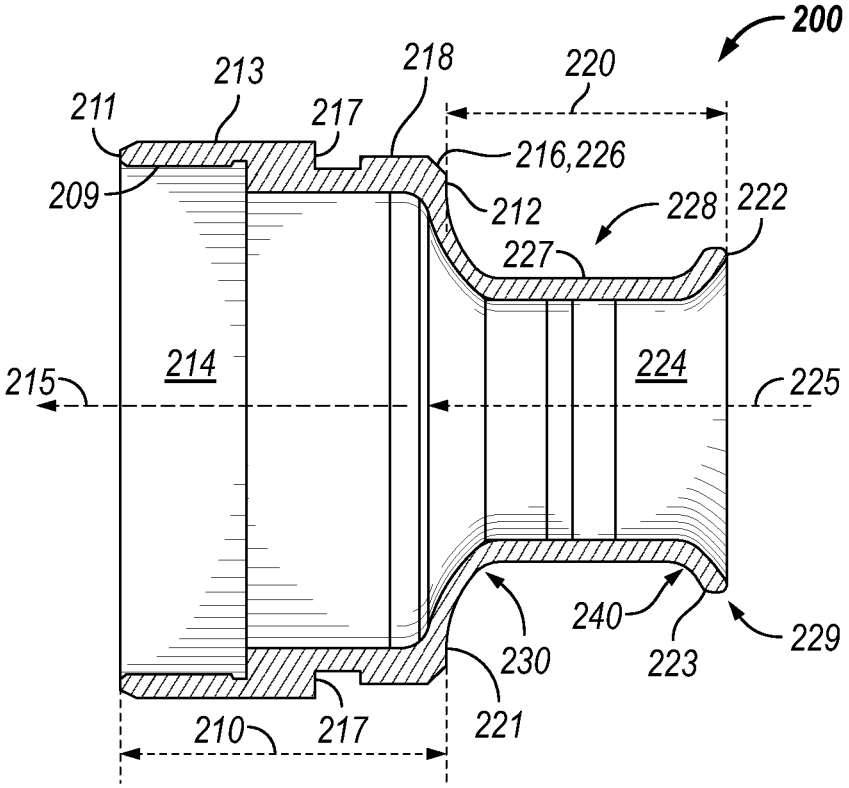
FIG. 5 is a cross-sectional view of an embodiment of a baffle for a shotgun suppressor.

FIG. 3 is an end view of a baffle 200 for a shotgun suppressor 500 and shows the interiors 214, 224 of the lower portion 210 (best shown in FIG. 2) and upper portion 220 (best shown in FIG. 2) of the baffle 200. FIG. 4 is a perspective view of a baffle 200 for a shotgun suppressor 500. FIG. 5 is a cross-sectional view of a baffle 200 for a shotgun suppressor 500. The baffle 200 includes a plurality of flats 219 located around the exterior 213 that enable a tool to be used to remove or attach the baffle 200 to components of a suppressor 500. The external threads 218 and the internal threads 209 (shown in FIG. 5) enable the baffle 200 to be threaded to the base 100, an extension tube 400, and/or an end cap 300 as would be appreciated by one of ordinary skill in the art having the benefit of this disclosure.

The baffle 200 may include one or more holes 250 in the upper portion 220 of the baffle 200. The one or more holes 250 enable fluid communication between the exterior 223 of the upper portion 220 of the baffle 200 and the interior 224 of the upper portion 220 of the baffle 200. The addition of one or more holes 250 may enable the baffle 200 to better reduce the discharge of a shotgun when connected to the shotgun as a component within a suppressor 500.

As shown in FIGS. 1-5, an embodiment of the disclosure is a baffle 200 for a shotgun suppressor 500. The baffle 200 includes a lower portion 210 having a first end 211, a second end 212, an exterior 213, an interior 214, and a first flow path 215 through the interior 214 of the lower portion 210. The second end 212 of the lower portion 210 has a first outer diameter 216. The baffle 200 includes an upper portion 220 having an interior 224, an exterior 223, and a second flow path 225 through the interior 224 of the upper portion 220. The upper portion 220 extends from the second end 212 of the lower portion 210. The upper portion 220 includes a first end 221, a middle section 227, and a second end 222. The second end 222 of the upper portion 220 is flared out and has a larger outer diameter 229 than an outer diameter 228 of the middle section 227. The baffle 200 includes external threads 218 on the exterior 213 of the lower portion 210. The baffle 200 includes internal threads 209 on the interior 214 of the lower portion 210.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A shotgun suppressor comprising:

a base having a first end, a second end, and a first passageway through the base from the first end to the second end, the base configured to be connected to a barrel of a shotgun;

an end cap, the end cap having a second passageway through an interior of the end cap;

at least one baffle positioned between the base and the end cap, the at least one baffle comprising:

a lower portion having a first end, a second end, an exterior, an interior, and a first flow path through the interior of the lower portion, wherein the second end of the lower portion has a first outer diameter;

an external shoulder on the exterior of the lower portion;

external threads on the exterior of the lower portion, wherein the external threads are adjacent to the second end of the lower portion;

an upper portion having an interior, an exterior, and a second flow path through the interior of the upper portion, the upper portion extends from the second end of the lower portion, the upper portion having a first end, a middle section, and a second end;

the first end of the upper portion has a second outer diameter that is substantially the same as the first outer diameter of the second end of the lower portion;

the middle section has a third outer diameter that is smaller than the second outer diameter of the first end of the upper portion;

the second end of the upper portion has a fourth outer diameter, wherein the fourth outer diameter is larger than the third outer diameter of the middle section and is smaller than the second outer diameter of the first end of the upper portion;

a first radius of curvature on the exterior of the upper portion, the first radius of curvature is located between the first end of the upper portion and the middle section of the upper portion, wherein the first radius of curvature decreases from the second outer diameter to the third outer diameter; and a second radius of curvature on the exterior of the upper portion, the second radius of curvature is located between the middle section of the upper portion and the second end of the upper portion, wherein the second radius of curvature increases from the third outer diameter to the fourth outer diameter;

wherein the first passageway, the first flow path, the second flow path, and the second passageway are all axially aligned; and wherein the third outer diameter is substantially constant between the first radius of curvature and the second radius of curvature.

2. The shotgun suppressor of claim 1, further comprising a first tube extension positioned between the base and the end cap, the first tube extension including a third passageway through an interior of the first tube extension and wherein the first passageway, the second passageway, the third passageway, the first flow path, and the second flow path are all axially aligned.

3. The shotgun suppressor of claim 2, wherein the exterior threads are located between the external shoulder and the upper portion of the at least one baffle.

4. The shotgun suppressor of claim 3, further comprising a plurality of flats on the exterior of the lower portion of the at least one baffle, wherein the plurality of flats are located between the external shoulder and the first end of the lower portion of the at least one baffle.

5. The shotgun suppressor of claim 4, wherein second end of the upper portion of the at least one baffle is bell-shaped.

6. The shotgun suppressor of claim 5, further comprising a second baffle positioned between the base and the end cap, the second baffle comprises:

a lower portion having a first end, a second end, an exterior, an interior, and a first flow path through the interior of the lower portion;

an upper portion having an interior, an exterior, and a second flow path through the interior of the upper portion, the upper portion extends from the second end of the lower portion, the upper portion having a first end, a middle section, and a second end; and wherein the second end of the upper portion of the second baffle is bell-shaped.

7. The shotgun suppressor of claim 6, further comprising a second tube extension positioned between the at least one baffle and the second baffle.

8. A baffle for a shotgun suppressor, the baffle comprising:

a lower portion having a first end, a second end, an exterior, an interior, and a first flow path through the interior of the lower portion, wherein the second end has a first outer diameter;

an upper portion having an interior, an exterior, and a second flow path through the interior of the upper portion, the upper portion extends from the second end of the lower portion, the upper portion having a first end, a middle section, and a second end;

the first end of the upper portion has a second outer diameter that is substantially the same as the first outer diameter of the second end of the lower portion;

the middle section has a third outer diameter that is smaller than the second outer diameter of the first end of the upper portion, wherein the third outer diameter is substantially constant;

the second end of the upper portion has a fourth outer diameter, wherein the fourth outer diameter is larger than the third outer diameter of the middle section and is smaller than the second outer diameter of the first end of the upper portion;

a first radius of curvature on the exterior of the upper portion, the first radius of curvature is located between the first end of the upper portion and the middle section of the upper portion, wherein the first radius of curvature decreases from the second outer diameter to the third outer diameter; and a second radius of curvature on the exterior of the upper portion, the second radius of curvature is located between the middle section of the upper portion and the second end of the upper portion, wherein the second radius of curvature increases from the third outer diameter to the fourth outer diameter.

9. The baffle of claim 8, wherein the second end of the upper portion is bell-shaped.

10. The baffle of claim 9, wherein the first flow path is axially aligned with the second flow path.

11. The baffle of claim 10, further comprising an external shoulder on the exterior of the lower portion.

12. The baffle of claim 11, further comprising external threads on the exterior of the lower portion, wherein the external threads are located between the external shoulder and the second end of the lower portion.

13. The baffle of claim 12, further comprising a plurality of flats on the exterior of the lower portion, wherein the plurality of flats are located between the external shoulder and the first end of the lower portion.

14. The baffle of claim 13, wherein the upper portion does not include any holes except the second flow path through the upper portion.

15. The baffle of claim 14, further comprising at least one hole through the lower portion, wherein the at least one hole provide communication between the interior of the lower portion and the exterior of the lower portion.

16. The baffle of claim 14, further comprising internal threads, wherein the internal threads are located on the interior of the lower portion.

* * * * *